US011584102B2

(12) United States Patent
Orsini et al.

(10) Patent No.: US 11,584,102 B2
(45) Date of Patent: Feb. 21, 2023

(54) FILL MATERIAL CUTTING MECHANISMS AND METHODS

(71) Applicant: Sealed Air Corporation (US), Charlotte, NC (US)

(72) Inventors: Thomas P. Orsini, Sterling, MA (US); Kostadin I. Kostadinov, Billerica, MA (US); Donald Durant, Andover, MA (US); Laura A. Favitta, Charlotte, NC (US); Russell T. Christman, Dunstable, MA (US)

(73) Assignee: Sealed Air Corporation (US), Charlotte, NC (US)

( * ) Notice: Subject to any disclaimer, the term of this patent is extended or adjusted under 35 U.S.C. 154(b) by 0 days.

(21) Appl. No.: 17/275,571

(22) PCT Filed: Sep. 12, 2019

(86) PCT No.: PCT/US2019/050772
§ 371 (c)(1),
(2) Date: Mar. 11, 2021

(87) PCT Pub. No.: WO2020/056106
PCT Pub. Date: Mar. 19, 2020

(65) Prior Publication Data

US 2022/0048270 A1 Feb. 17, 2022

Related U.S. Application Data

(60) Provisional application No. 62/731,125, filed on Sep. 14, 2018.

(51) Int. Cl.
*B31D 5/00* (2017.01)

(52) U.S. Cl.
CPC ..... *B31D 5/0039* (2013.01); *B31D 2205/007* (2013.01); *B31D 2205/0052* (2013.01); *B31D 2205/0058* (2013.01)

(58) Field of Classification Search
CPC ..... B31D 5/0039; B31D 2205/0052; B31D 2205/0058; B31D 2205/007
See application file for complete search history.

(56) References Cited

U.S. PATENT DOCUMENTS 3,411,390 A * 11/1968 Maynard ..... B26D 3/14 83/100
3,716,132 A * 2/1973 Lewyckyj ..... A41D 31/02 83/695
3,795,163 A * 3/1974 Armstrong ..... B26D 1/04 206/390

(Continued)

FOREIGN PATENT DOCUMENTS

GB 2322643 A 9/1998

*Primary Examiner* — Thomas M Wittenschlaeger
*Assistant Examiner* — Katie L Gerth
(74) *Attorney, Agent, or Firm* — Jon M. Isaacson

(57) ABSTRACT

A system includes a source of sheet material and a conversion machine. The conversion machine is configured to receive the sheet material and to form the sheet material into a fill material. The conversion machine further includes a cutting mechanism configured to cut the fill material. The cutting mechanism is configured such that, when cutting the fill material to form two pieces of fill material, uncut portions of the fill material remain between the two pieces of fill material.

16 Claims, 6 Drawing Sheets

(56) References Cited

U.S. PATENT DOCUMENTS 3,835,754 A * 9/1974 Lewyckyj ..... A61F 13/00995 83/349
4,285,681 A * 8/1981 Walitalo ..... B29C 66/4312 493/203
4,358,979 A * 11/1982 Kurzbuch ..... B26D 7/20 83/660
4,699,031 A * 10/1987 D'Angelo ..... B65H 35/06 83/261
5,123,889 A * 6/1992 Armington ..... B26D 1/30 83/628
5,203,761 A * 4/1993 Reichental ..... B31D 5/006 493/346
5,232,430 A * 8/1993 Nitsch ..... B26D 7/27 83/695
5,593,376 A * 1/1997 Armington ..... B31D 5/0047 493/464
6,179,765 B1 * 1/2001 Toth ..... B65H 16/06 493/464
6,277,459 B1 * 8/2001 Lencoski ..... B65D 81/09 428/218
6,676,589 B2 * 1/2004 Kung ..... B31F 1/0003 493/464
6,910,997 B1 * 6/2005 Yampolsky ..... B26F 1/22 493/464
7,815,989 B2 * 10/2010 Cheich ..... B31D 5/0047 428/43
8,016,735 B2 * 9/2011 Wetsch ..... B65H 35/008 493/464
9,254,578 B2 * 2/2016 Wetsch ..... B31D 5/0043
10,792,882 B2 * 10/2020 Wetsch ..... B65H 20/26
11,123,943 B2 * 9/2021 Cheich ..... B31D 5/0047
2004/0266598 A1 * 12/2004 Toth ..... B31D 5/0052 493/350
2005/0215408 A1 9/2005 Yampolsky et al.
2008/0070773 A1 * 3/2008 Wetsch ..... B31D 5/0052 493/464
2009/0258775 A1 * 10/2009 Chan ..... B31D 5/0043 493/464
2011/0319245 A1 * 12/2011 Wetsch ..... B31D 5/0052 493/464
2012/0072016 A1 * 3/2012 Sperry ..... B31D 5/0073 221/199
2014/0274645 A1 * 9/2014 Wetsch ..... B65H 35/008 493/360
2014/0373972 A1 * 12/2014 Frayne ..... B65D 81/052 141/94
2017/0095991 A1 * 4/2017 Wetsch ..... B65H 35/008
2017/0100906 A1 * 4/2017 Beaver ..... B31D 5/006
2017/0259522 A1 * 9/2017 Cheich ..... A63J 5/021

* cited by examiner

FILL MATERIAL CUTTING MECHANISMS AND METHODS

BACKGROUND

The present disclosure is in the technical field of dunnage or packaging materials. More particularly, the present disclosure is directed to method for producing package fill material from sheets of a selected substrate, such as paper.

Conversion machines for producing fill material from paper are well-known. Such conversion machines generally operate by pulling a web of paper from a roll or fanfold paper, manipulating the paper web in such a way as to convert the paper into fill material, and then severing the converted material into cut sections of a desired length. Conversion machines may be void fill conversion machines that form sheet material into fill material that can be used as void fill, cushion conversion machines that form sheet material into fill material that can be used as cushioning, or any other similar conversion machine. While such conversion machines are widely used and have been commercially successful in many applications, there is a need for improved functionality and decreased cost of some of the components of such conversion machines.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In a first embodiment, a system includes a source of sheet material and a conversion machine. The conversion machine is configured to receive the sheet material and to form the sheet material into a fill material. The conversion machine further includes a cutting mechanism configured to cut the fill material. The cutting mechanism is configured such that, when cutting the fill material to form two pieces of fill material, uncut portions of the fill material remain between the two pieces of fill material.

In a second embodiment, the previous embodiment is configured such that the uncut portions are arranged such that, when one of the two pieces of the fill material is pulled away from each other, the uncut portions tear, resulting in the two pieces of the fill material being separated from each other.

In a third embodiment, any of the previous embodiments is arranged such that a percentage of a width of the fill material that remains connected by the uncut portions is in a range between about 1% and about 10%.

In a fourth embodiment, any of the previous embodiments is arranged such that a width of the fill material that remains connected by the uncut portions is in a range between about 3% and about 9%.

In a fifth embodiment, any of the previous embodiments is arranged such that a percentage of a width of the fill material that remains connected by the uncut portions is in a range between about 5% and about 8%.

In a sixth embodiment, any of the previous embodiments is arranged such that a percentage of a width of the fill material that remains connected by each of the uncut portions is less than or equal to any one of 1%, 0.8%, 0.6%, 0.4%, or 0.2%.

In a seventh embodiment, any of the previous embodiments is arranged such that the cutting mechanism includes a first cutting surface and a second cutting surface, and at least one of the first and second cutting surfaces is configured to move with respect to the other of the first and second cutting surfaces to cut portions of the fill material.

In an eighth embodiment, the seventh embodiment is configured such that the first cutting surface is a notched blade that includes a notch.

In a ninth embodiment, the eighth embodiment is configured such that a length of the notch is a percentage of a length of the first cutting surface that is less than or equal to or any one of 10%, 9%, 8%, 7%, 6%, 5%, 4%, 3%, 2%, or 1%.

In a tenth embodiment, any of the seventh through ninth embodiments is configured such that the fill conversion machine is configured to fold or crumple the sheet material to form the fill material.

In an eleventh embodiment, the tenth embodiment is configured such that, after the sheet material is folded or crumpled to form the fill material, multiple plies of the fill material are arranged to be cut by the cutting mechanism.

In a twelfth embodiment, any of the previous embodiments is arranged such that the cutting mechanism includes a single cutting surface that includes a notch.

In a thirteenth embodiment, the twelfth embodiment is configured such that the single cutting surface is configured to move into a slot as the single cutting surface cuts the fill material.

In a fourteenth embodiment, any of the previous embodiments is arranged such that the cutting mechanism includes at least two separate cutting surfaces that are separated by a gap and the uncut portions of the fill material are aligned with the gap as the cutting mechanism cuts the fill material.

In a fifteenth embodiment, the fourteenth embodiment is configured such that the at least two separate cutting surfaces is configured to move into a slot as the at least two separate cutting surfaces cut the fill material.

In a fifteenth embodiment, any of the fourteenth or fifteenth embodiments is configured such that the gap has a length that is in a range between about 0.1 inches and about 0.15 inches.

In a seventeenth embodiment, a method includes converting, by a fill conversion machine, a sheet material into a fill material and cutting, by a cutting mechanism of the fill conversion machine, the fill material to form two pieces of fill material. The cutting includes leaving uncut portions of the fill material between the two pieces of fill material. The two pieces of fill material include a first piece and a second piece. The method further includes holding, by the conversion machine, a second piece of the two pieces of fill material. The first piece is separable from the second piece during the holding by pulling the first piece from the second piece to cause the uncut portions of the fill material to tear.

In an eighteenth embodiment, the method of the seventeenth embodiment further includes detecting, by the conversion machine, that the first piece has been pulled away from the second piece.

In a nineteenth embodiment, the method of the eighteenth embodiment further includes, in response to the detecting, automatically advancing, by the conversion machine, the fill material out of the fill conversion machine and in response to the detecting, automatically cutting, by the cutting mechanism of the conversion machine, the fill material to form a cut between the second piece and a third piece of the fill material such that uncut portions of the fill material remain between the second and third pieces of fill material.

In a twentieth embodiment, the method of the nineteenth embodiment further includes holding, by the conversion machine, the third piece of fill material. The second piece is separable from the third piece during the holding of the third piece by pulling the second piece from the third piece to cause the uncut portions of the fill material between the second and third pieces to tear.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

Figure 1:
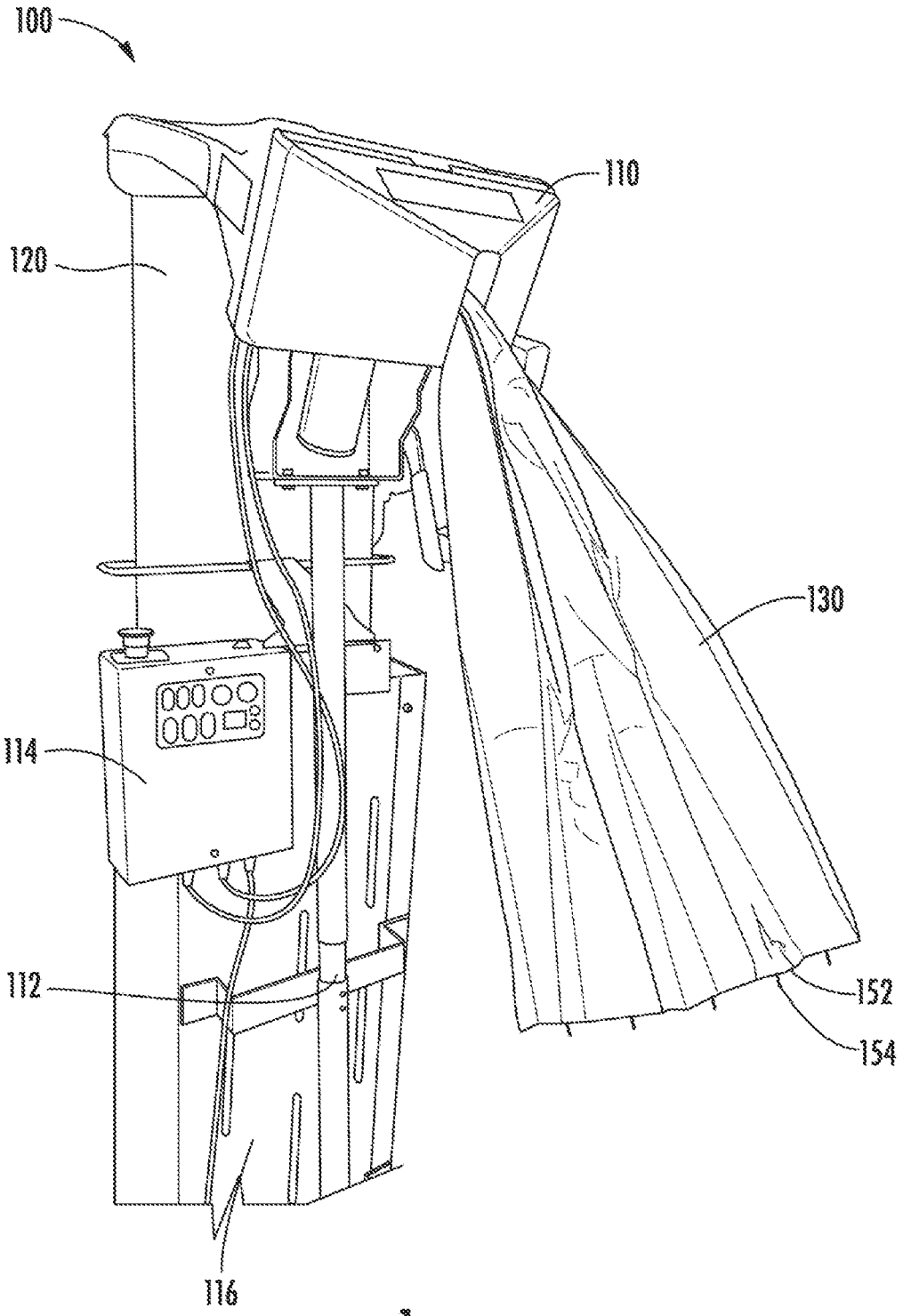
FIG. 1 depicts an embodiment of a conversion machine for producing fill material, a source of sheet material, and an embodiment of fill material cutting using one of the embodiments of cutting mechanisms described herein.

Referring to FIG. 1, a system 100 is depicted that includes a conversion machine 110 for producing fill material 130 from a sheet material 120 of a selected substrate. In FIG. 1, the conversion machine 110 is depicted being supported by a support stand 112 that is configured to stand on the floor. Other configurations of the conversion machine 110 are possible, such as a tabletop configuration of the conversion machine 110. In the depicted configuration, the conversion machine 110 the support stand may be height adjustable or otherwise configurable us a user. Other related components, such as a control unit 114, a sheet supply bin 116, and a support base (not visible) may also be connected to the stand 112. The control unit 114 may include a user interface or other user operable switches, buttons, dials or other controls to manage operation of the conversion machine 110. For example, the control unit 114 may include an emergency stop button or other controls that allow an operator to adjust modes of operation or to select a particular length of fill material to dispense. The sheet supply bin 116 is sized and shaped to accommodate different sheet sizes and densities. In one embodiment, the size of the supply bin 116 may be adjustable to accommodate different sheet supply widths, for example 15" or 30" wide fanfold stock. In another embodiment, a sheet of fill material can be supplied to the conversion machine 110 in the form of a roll of stock sheet material. Thus, a horizontal bar (not shown) might be secured nearby or directly to the stand 112 to support such a roll of stock sheet material. In one embodiment, the sheet supply bin 116 might be positioned near, but not directly coupled to the conversion machine 110. In some embodiments, a support base secured to the stand 112 to a stable platform such as legs, casters, a table, or any other mounting location (e.g., a work bench or a product conveyor). The support base may be secured to a fixed or mobile platform as appropriate depending on the requirements of a particular packaging environment.

The conversion machine 110 is configured to receive a sheet material 120 and to convert the sheet material 120 into fill material 130. The fill material 130 has a configuration that is different from the sheet material. In some embodiments, the conversion machine 110 is configured to crush, crumple, fold, or otherwise deform the sheet material 120 from its sheet orientation into the non-sheet orientation of the fill material 130. The conversion machine 110 may include crush wheels, gears, deforming cylinders, folding bars, folding plates, pulleys, or other deforming components that are in the path of the sheet material 120 to cause the sheet material 120 to be converted from its sheet orientation (substantially a two-dimensional form) to the non-sheet orientation of the void fill material 130 (substantially a three-dimensional form). Examples of such Most conversion machines include a severing mechanism to periodically sever the converted fill material into pieces of fill material. The severed pieces can then be inserted into a container (e.g., a shipping box) as void fill or placed around an object as cushioning. One difficulty with severing the converted fill material is ensuring that the severed piece of fill material does not unintentionally fall out of the conversion machine. When severed pieces fall out of the conversion machine, a packer typically needs to spend extra time collecting the fallen piece and, in some cases, the piece is no longer usable. To address this problem, a catching device, such a bin, can be used to catch and hold severed pieces of fill material that fall out of the conversion machine. However, these catching devices can take up more space than is desirable in a packing environment and may not be ergonomical for a packer, such as if the packer must repeatedly bend down to pick up severed pieces of fill material out of the catching device. Another solution to this problem has been to provide a chute that directs falling pieces of severed fill material to the user. However, these chutes also take up space, may require the conversion machine to be moved away from the user, and do not solve the issue of intended dispensing of severed pieces of fill material.

Another solution that has been developed for some conversion machines is a conversion machine mode that is sometimes called "cut-and-hold." When using a cut-and-hold option, a conversion machine typically produces a predetermined length of fill material and then cuts the material to form a separated piece of fill material. The conversion machine then retains the piece of fill material for the packer to remove from the conversion machine. This retention is usually accomplished through friction between the piece of fill material and the conversion machine. Once the packer removes the piece of fill material from the conversion machine, the conversion machine produces another piece of fill material, cuts the material to form a new separated piece of fill material, and retains the new piece of fill material until the packer removes it from the conversion machine. However, the friction caused by the retention system has a tendency to jam the conversion machine, particularly when the conversion machine operates at high speeds (e.g., 300 feet/minute or more). Jamming of paper in the conversion machine results in down time of the conversion machine and labor costs to unjam the conversion machine. To compensate for jamming, the amount of tension or friction could be reduces on the retention system. However, with less friction and/tension during some of the hold periods, the retained piece of fill material sometimes falls out of the conversion machine (e.g., due to air flow—such as from fans—in the packer's area). When the retained piece of fill material falls out, the conversion machine produces another piece of fill material because it senses that the paper has been removed. This results in some of the same issues described above. Not only are the same issues present, but the cost and complexity of the conversion machine have risen due to the need for the retention system that holds pieces of fill material after they have been severed.

Described herein are embodiments of cutting mechanisms for conversion machines that do not fully separate two pieces of fill material but allow for a packer to manually separate the two pieces of fill material. In some embodiments, the cutting mechanism leaves a number of uncut portions across the cut ends of the two pieces of fill material. In some embodiments, the uncut portions are sufficiently small such that a packer can manually pull on one of the two pieces of cut fill material to cause the uncut portions to tear, resulting in the two pieces of cut fill material being separate from each other. In some examples, the percentage of the width of the cut fill material that is connected by all the uncut portions after the material is cut is in a range that is at least one of a range from about 1% to about 10%, a range from about 3% to about 9%, or a range from about 5% to about 8%. In some examples, the percentage of the width of the cut fill material that is connected by one of the uncut portions after the material is cut is less than or equal to any one of 1%, 0.8%, 0.6%, 0.4%, or 0.2%. In some embodiments, the uncut portions are capable of maintain the two pieces connected until one of the pieces is pulled away from the other (e.g., pulled away by a packer). One benefit of the amount of fill material that remains uncut being relatively small is that the packer typically does not need to exert much force to tear the uncut portions as the packer pulls the two pieces apart. In some cases, the packer is unable to distinguish any difference in the amount of force required to pull out a piece of fill material from a cut-and-hold conversion machine (e.g., in existing conversion machines) and the amount of force required to tear the uncut portions of the paper that remain when using the cutting mechanisms in the embodiments described herein.

Figure 2:
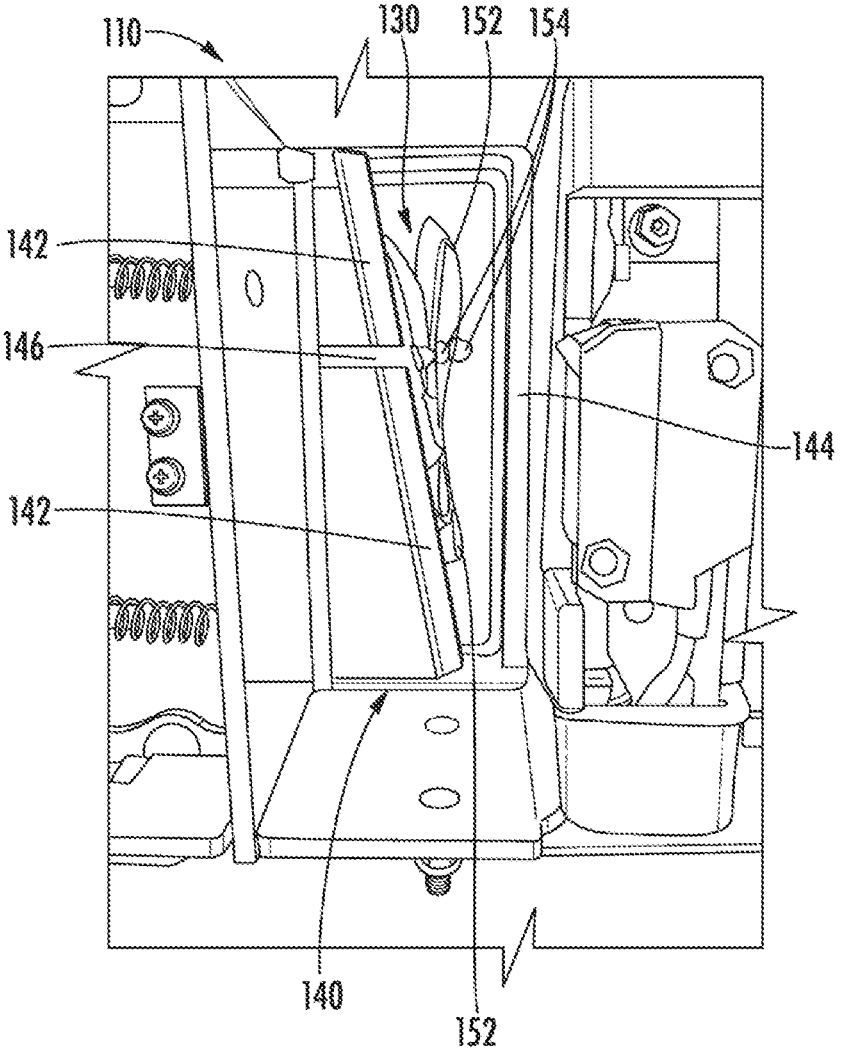
FIG. 2 depicts an embodiment of a cutting mechanism capable of cutting converted sheet material in accordance with the cutting methods described herein.

Depicted in FIG. 2 is an embodiment of a cutting mechanism 140 in the conversion machine 110. In some embodiments, the cutting mechanism 140 includes a cutting surface 142 and a cutting surface 144. In some embodiments, at least one of the cutting surfaces 142 and 144 is configured to move with respect to the other to cut portions of the fill material 130. The cutting mechanism 140 is also configured such that, when the cutting mechanism 140 cuts the void fill material 130, the fill material 130 leaves a number of uncut portions across the cut ends of the fill material 130.

In the depicted embodiment, the cutting surface 142 in the cutting mechanism 140 is a notched blade that has a notch 146 in the cutting surface 142. As can be seen in FIG. 2, the conversion machine 110 is configured to fold or crumple the sheet material 120 to form the fill material 130 so that multiple plies of the fill material 130 are located between the two cutting surfaces 142 and 144. The notch 146 is located on the cutting surface 142 so that multiple plies of the fill material 130 are aligned with the notch 146. In some embodiments, the length of the notch 146 is a percentage of the length of the cutting surface 142 that is less than or equal to any one of 10%, 9%, 8%, 7%, 6%, 5%, 4%, 3%, 2%, or 1%.

Figure 5:
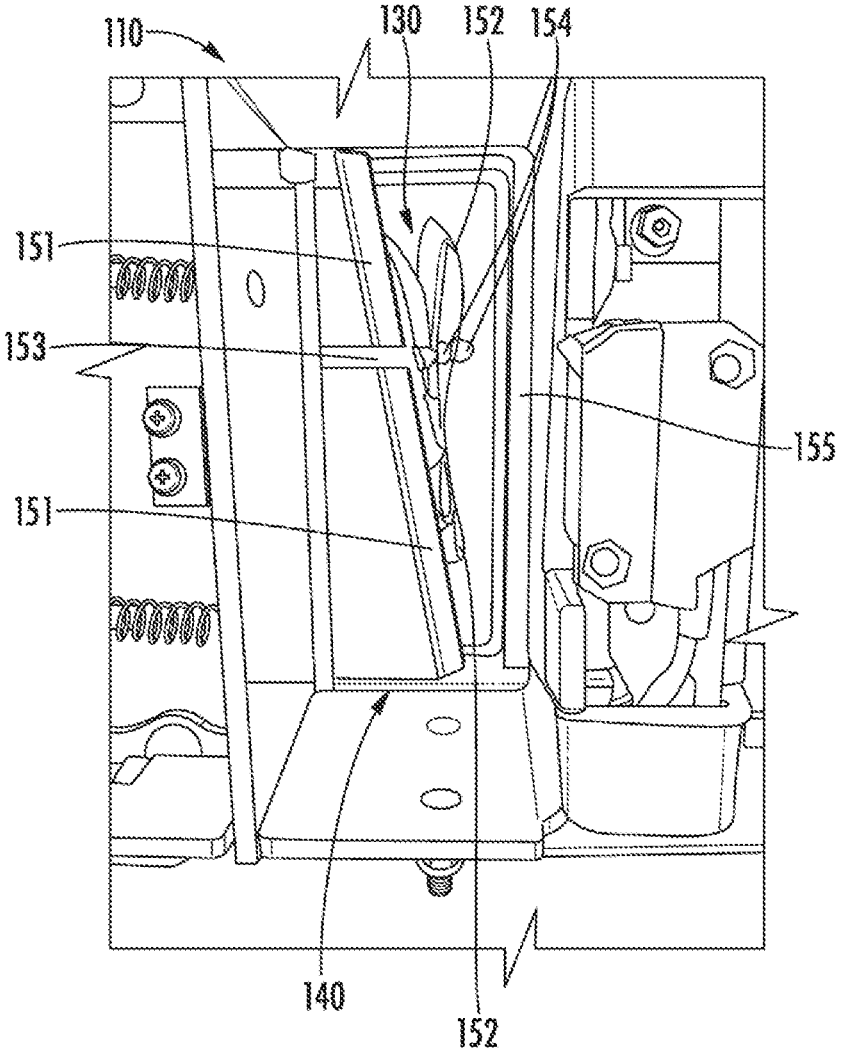
FIG. 5 depicts an embodiment of a cutting mechanism capable of cutting converted sheet material in accordance with the cutting methods described herein.
Figure 6:
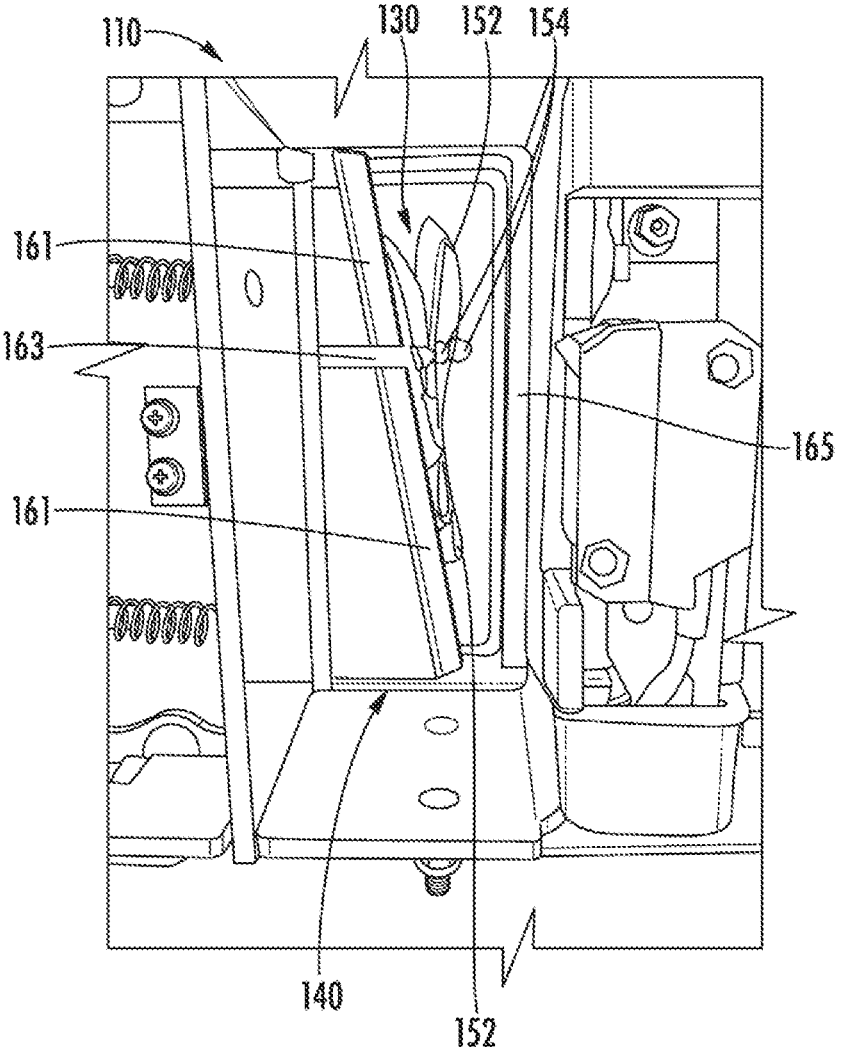
FIG. 6 depicts an embodiment of a cutting mechanism capable of cutting converted sheet material in accordance with the cutting methods described herein.

In other embodiments, such as shown in FIG. 5, the cutting mechanism 140 can have a single cutting surface 151. In those embodiments, the fill material 130 can be located between the single cutting surface 151 and a slot 155, and the single cutting surface 151 can move into the slot 155 as the single cutting surface 151 cuts the fill material 130. In those embodiments, the single cutting surface 151 can include a notch 153 that is aligned with the uncut portions of the fill material 130 when the single cutting surface 151 cuts the fill material 130. In other embodiments, such as shown in FIG. 6, the cutting mechanism 140 can have at least two cutting surfaces 161. In those embodiments, the fill material 130 can be located between the at least two cutting surfaces 161 and a slot 165, and the at least two cutting surfaces 161 can move into the slot 165 as the at least two cutting surfaces 161 cut the fill material 130. In those embodiments, the at least two cutting surfaces 161 can be separated by a gap 163 and the gap 163 is aligned with the uncut portions of the fill material 130 when the at least two cutting surfaces 161 cut the fill material 130.

At the instance depicted in FIG. 2, a leading end 152 of the fill material 130 is at the cutting surfaces 142 and 144 where it was previously cut by the cutting surfaces 142 and 144 from a now-separated piece of the fill material 130. The leading end 152 includes tabs 154. The tabs 154 are substantially aligned with the notch 146, indicating that the tabs 154 were the uncut portions of the fill material when the cutting surfaces 142 and 144 cut the fill material 130 before the now-separated piece of the fill material 130 was removed. The tabs 154 remained on the leading end 152 when the now-separated piece of the fill material 130 was removed (e.g., pulled away by a packer). In any of the embodiments described herein, a notch in a cutting surface or a gap between cutting surfaces can have a length that is in a range between about 0.01 inches and about 0.25 inches, in a range between about 0.05 inches and about 0.2 inches, or in a range between about 0.1 inches and about 0.15 inches.

From the position shown in FIG. 2, the conversion machine 110 can advance the fill material 130 to the position shown in FIG. 1. At the position shown in FIG. 1, the leading end 152 of the fill material 130 is out away from the conversion machine 110. At that point, the cutting mechanism 140 inside of the conversion machine 110 can cut the fill material 130. Depicted in FIG. 3 is an embodiment of two pieces 150 and 160 of the fill material 130 after the cut is made in the fill material 130 when the fill material is in the position shown in FIG. 1 and before the two pieces 150 and 160 of cut fill material 130 have been separated.

Figure 3:
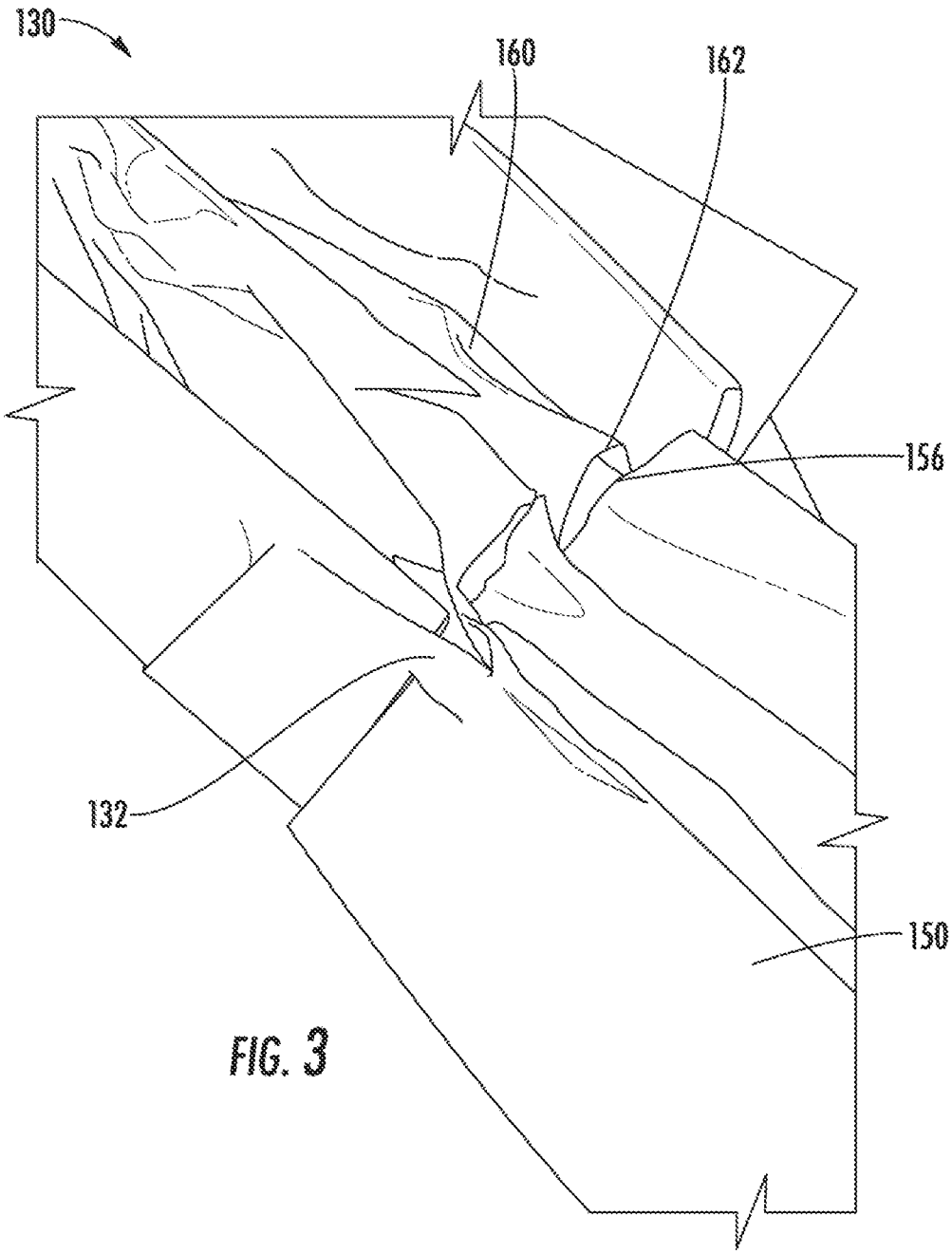
FIG. 3 depicts an embodiment of two pieces of cut fill material before the two pieces of cut fill material have been separated, in accordance with the embodiments described herein.

As can be seen in FIG. 3, the cutting mechanism 140 cut through multiple folded or crumpled plies of the fill material 130 to form a trailing end 156 in the piece 150 of the fill material 130 and a leading end 162 in the piece 160 of the fill material 130. The notch 146 of the cutting surface 142 left a number of uncut portions 132 (though only one is visible in FIG. 3) across the cut trailing end 156 and leading end 162 of the two pieces 150 and 160 of the fill material 130. With the uncut portions 132 of the fill material 130 in place, the two pieces 150 and 160 of the fill material 130 remain connected to each other. This keeps the piece 150 connected to the piece 160 until the piece 150 is pulled from the piece 160. Thus, when the piece 160 is part of the fill material 130 inside the conversion machine 110, the conversion machine continues to hold the piece 150 on the end of the piece 160 until the piece 150 is pulled away from the piece 160.

Figure 4:
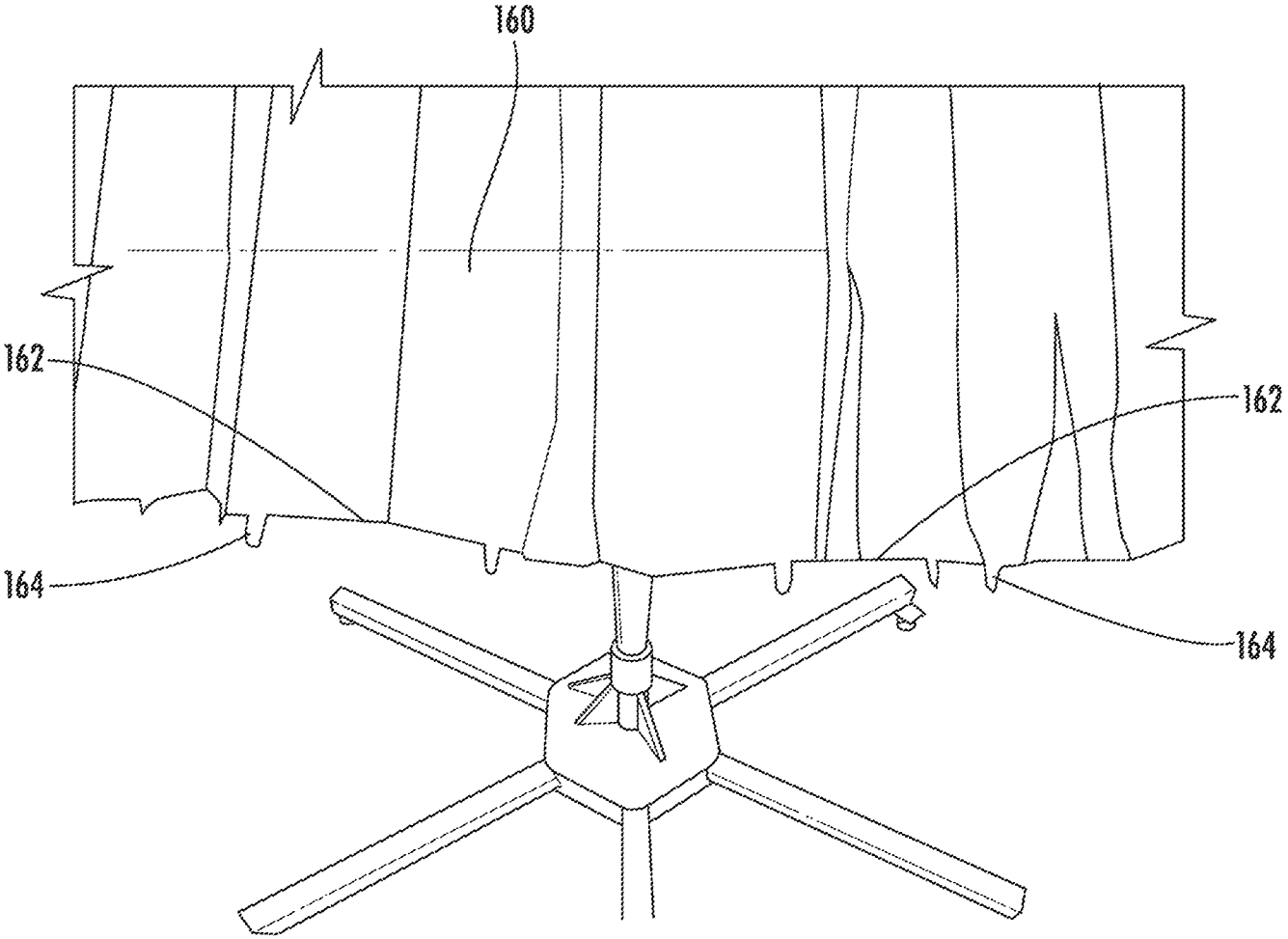
FIG. 4 depicts an embodiment of one of the two pieces of cut fill material shown in FIG. 3 after the two pieces of cut fill material have been separated, in accordance with the embodiments described herein.

Depicted in FIG. 4 is a n example of the piece 160 of the fill material 130 after the two pieces 150 and 160 of the fill material 130 have been separated from each other. In some embodiments, the piece 150 was separated from the piece 160 by a person (e.g., a packer) pulling the piece 150, which caused the uncut portions 132 between the two pieces 150 and 160 to tear. In the depicted embodiment, most of the uncut portions 132 tore on the side of the uncut portions 132 closer to the piece 150 such that the uncut portions 132 became tabs 164 on the leading end 162 of the piece 160 when the piece 150 was pulled away from the piece 160.

As described above, a piece of fill material can be created by a process that includes advancing the fill material 130 by the conversion machine 110, cutting the fill material 130 by a cutting mechanism 140 that leaves uncut portions between two pieces, and pulling the piece away from the fill material 130 by a person to tear the uncut portions. The piece of the fill material 130 is then separated and can be used as fill. In some embodiments, the conversion machine 110 can detect that the piece has been torn away and then automatically advance the fill material 130 and cut the material 130 so that uncut portions remain. This process can be repeated as many times as the person continues to pull pieces away from the fill material 130.

Some of the benefits of the embodiments described herein over existing conversion machines include reduced complexity, lower cost, and greater reliability. With cut-and-hold systems, not only do those systems have a severing mechanism but also a tension holding mechanism. In contrast, the embodiments disclosed herein include a cutting mechanism that leaves uncut portions of the fill material after a cut instead of having both a severing mechanism and a tension holding mechanism. This not only reduces cost because of the reduced number of parts, but also reduces the complexity of the conversion machine because the fill material holds the cut piece instead of a tension mechanism in the conversion machine holding the cut piece. In addition, the issue of inadvertent falling of fill pieces in existing system is addressed by the embodiments described herein because the uncut portions prevent a cut piece of fill from falling from the force of gravity alone. This increases the reliability of the embodiments disclosed herein over existing conversion machines.

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. A system comprising:

a source of sheet material; and a conversion machine configured to receive the sheet material and to form the sheet material into a fill material, wherein the conversion machine further comprises:

a cutting mechanism configured to cut the fill material, the cutting mechanism having a linear cutting blade having only one notch or gap in the linear cutting blade, wherein the cutting mechanism is configured such that, when cutting the fill material to form two pieces of fill material, wherein the linear cutting blade is arranged so that the notch or gap leaves a plurality of uncut portions in the fill material between the two pieces of fill material.

2. The system of claim 1, wherein the uncut portions are arranged such that, when one of the two pieces of the fill material is pulled away from each other, the uncut portions tear, resulting in the two pieces of the fill material being separated from each other.

3. The system of claim 1, wherein a percentage of a width of the fill material that remains connected by the uncut portions is in a range between about 1% and about 10%.

4. The system of claim 1, wherein a percentage of a width of the fill material that remains connected by the uncut portions is in a range between about 3% and about 9%.

5. The system of claim 1, wherein a percentage of a width of the fill material that remains connected by the uncut portions is in a range between about 5% and about 8%.

6. The system of claim 1, wherein a percentage of a width of the fill material that remains connected by each of the uncut portions is less than or equal to any one of 1%, 0.8%, 0.6%, 0.4%, or 0.2%.

7. The system of claim 1, wherein the cutting mechanism includes a first cutting surface and a second cutting surface, wherein the first cutting surface includes the linear cutting blade, and wherein at least one of the first and second cutting surfaces is configured to move with respect to the other of the first and second cutting surfaces to cut portions of the fill material.

8. The system of claim 7, wherein the linear cutting blade is a notched blade that includes the notch.

9. The system of claim 8, wherein a length of the notch is a percentage of a length of the first cutting surface that is less than or equal to or any one of 10%, 9%, 8%, 7%, 6%, 5%, 4%, 3%, 2%, or 1%.

10. The system of claim 7, wherein the fill conversion machine is configured to fold or crumple the sheet material to form the fill material.

11. The system of claim 8, wherein, after the sheet material is folded or crumpled to form the fill material, multiple plies of the fill material are arranged to be cut by the cutting mechanism.

12. The system of claim 1, wherein the linear cutting blade includes a single cutting surface that includes the notch.

13. The system of claim 12, wherein the single cutting surface is configured to move into a slot as the single cutting surface cuts the fill material.

14. The system of claim 1, wherein the linear cutting blade includes at least two separate cutting surfaces that are separated by the gap, and wherein the uncut portions of the fill material are aligned with the gap as the linear cutting blade cuts the fill material.

15. The system of claim 14, wherein the at least two separate cutting surfaces is configured to move into a slot as the at least two separate cutting surfaces cut the fill material.

16. The system of claim 14, wherein the gap has a length that is in a range between about 0.1 inches and about 0.15 inches.

* * * * *